US005319906A

United States Patent [19]

Hayden

[11] Patent Number: 5,319,906

[45] Date of Patent: Jun. 14, 1994

[54] STAGE PLATFORM ASSEMBLY AND METHOD OF MAKING SAME

[76] Inventor: Michael Hayden, 6704 Parkwood La., Minneapolis, Minn. 55436

[21] Appl. No.: 879,774

[22] Filed: May 6, 1992

[51] Int. Cl.[5] ..... E04H 3/28

[52] U.S. Cl. ..... 52/127.6; 52/7; 52/656.9

[58] Field of Search ..... 52/6, 7, 127.6, 79.5, 52/656.9

[56] References Cited

U.S. PATENT DOCUMENTS

| | | | |
|---|---|---|---|
| 3,181,203 | 5/1965 | Wenger | 52/7 |
| 3,210,895 | 10/1965 | Graf | 52/7 |
| 3,864,051 | 2/1975 | Reid | 52/656.9 |
| 4,104,835 | 8/1978 | Bardwick, III | 52/7 |
| 4,527,364 | 9/1985 | Baus | 52/656.9 |
| 4,580,776 | 4/1986 | Burkinshaw | 52/7 |
| 4,735,024 | 4/1988 | Rosato et al. | 52/7 |

FOREIGN PATENT DOCUMENTS

| | | | |
|---|---|---|---|
| 0527768 | 7/1956 | Canada | 52/7 |
| 3535191 | 4/1986 | Fed. Rep. of Germany | 52/7 |
| 244381 | 4/1987 | Fed. Rep. of Germany | 52/127.6 |
| 1266963 | 1/1970 | United Kingdom | 52/126.6 |

*Primary Examiner*—Carl D. Friedman
*Assistant Examiner*—Wynn E. Wood
*Attorney, Agent, or Firm*—Hugh D. Jaeger

[57] ABSTRACT

A stage platform assembly including a corner extrusion member for engagement in a box channel member, and a corner securing member for engagement about tongues of the corner extrusion member at the four corners of sections of the box channel member. A stage platform, such as plywood, secures in a protected fashion to the box channel member. Posts or other elevational members can engage in the corner extrusion member for securing sections of the stage platform together. Locks can also be utilized to secure the stage platform assemblies together.

8 Claims, 5 Drawing Sheets

STAGE PLATFORM ASSEMBLY AND METHOD OF MAKING SAME

CROSS-REFERENCE TO CO-PENDING APPLICATIONS

None

BACKGROUND OF THE INVENTION

1. Field of the Invention

The present invention pertains to a stage platform assembly, and more particularly, pertains to three extruded members which when joined together, form a stage platform assembly which protectively engages plywood or other suitable material.

2. Description of the Prior Art

Stage platforms in the past have been specially constructed wooden platforms or wooden platforms joined together through an assortment of bolts and nuts or other suitable fastening means. The platform sections have not always been integral and dimensionally accurate with respect to each other. Vertical storage of the two platforms incurred excessive wear and tear along and about the top plywood platform members.

The present invention provides a stage platform assembly which provides rectangles or squares which are rigid and which can be securedly connected with respect to each other. Extruded side members provide for protection of a wood top member.

SUMMARY OF THE INVENTION

The general purpose of the present invention is a stage platform assembly utilizing extruded structures which when connected together form a solid and rigid platform. Sections of the stage platform assembly can be connected together with respect to each other to form a large stage platform.

According to one embodiment of the present invention, there is provided a stage platform assembly including box channel members which engage with corner extrusion members and a like number of corner securing members. A platform, such as a piece of plywood, engages within the box channel members. Appropriate members or legs secure into the corner extrusion members for support of the stage platform assembly and secure the stage platform assemblies together with respect to each other to form a stage platform.

Significant aspects and features of the present invention include a stage platform assembly which is easily constructed from extruded members and repetitive stage platform assemblies of exact dimensions can likewise be constructed.

Other significant aspects and features of the present invention include extruded members which are easily fabricated using common tools once the extrusion members have been extruded into a stage platform. No special hand tools or power equipment is necessary other than a table saw, a drill press, an electric drill, and socket wrenches.

Another significant aspect and feature of the present invention is a wood top member having edges bounded and protected by an extruded channel member.

Having thus described the embodiments of the present invention, it is a principal object hereof to provide a stage platform assembly and a process of making the same.

One object of the present invention is to provide a stage platform assembly utilizing extruded components of a light-weight, sound and structural integrity, having a protected top hood member.

Another object of the present invention is to provide stage platform assemblies which can repetitively be built of exacting dimensions.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
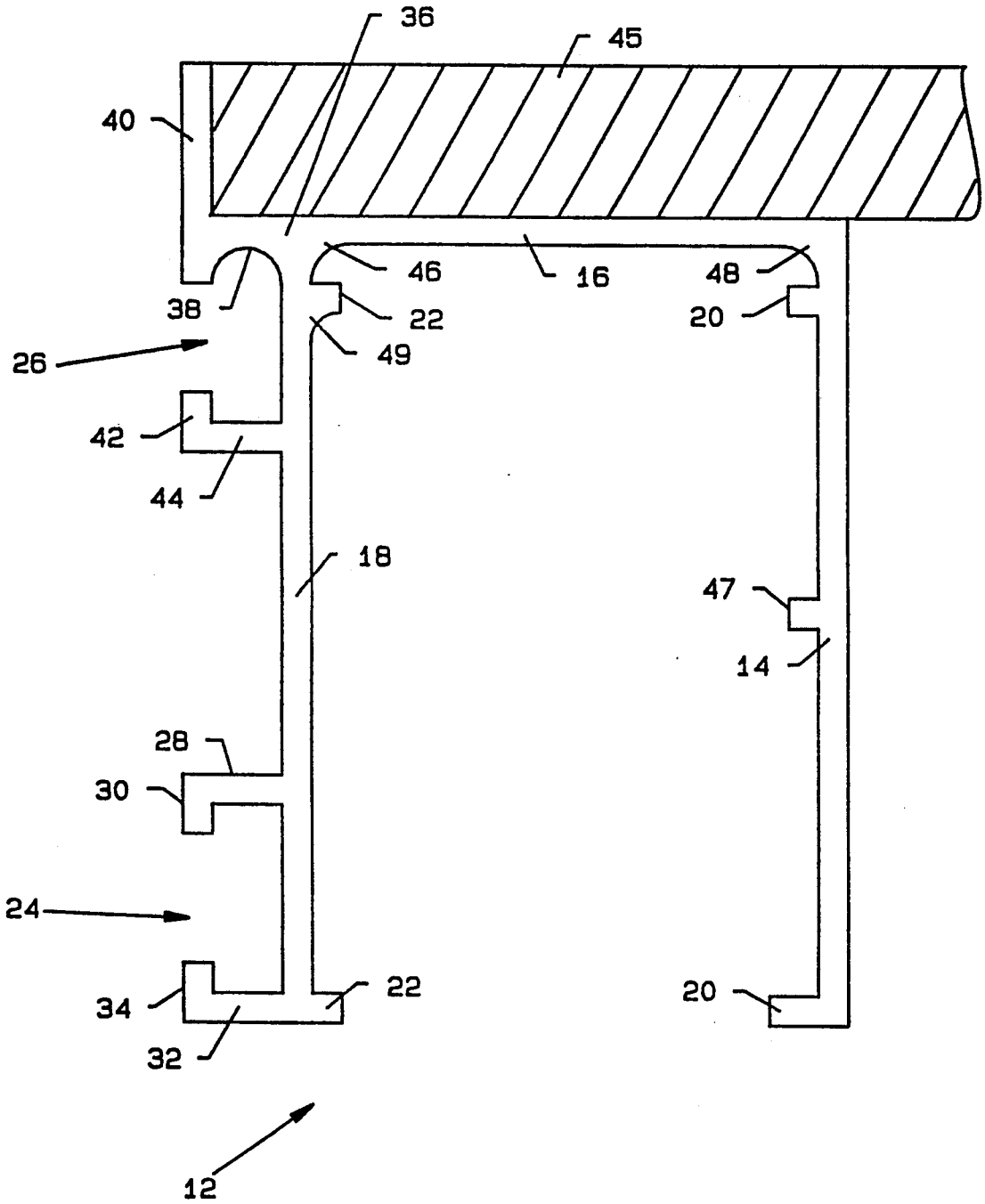
FIG. 1 illustrates an end view of a box channel member.
Figure 5:
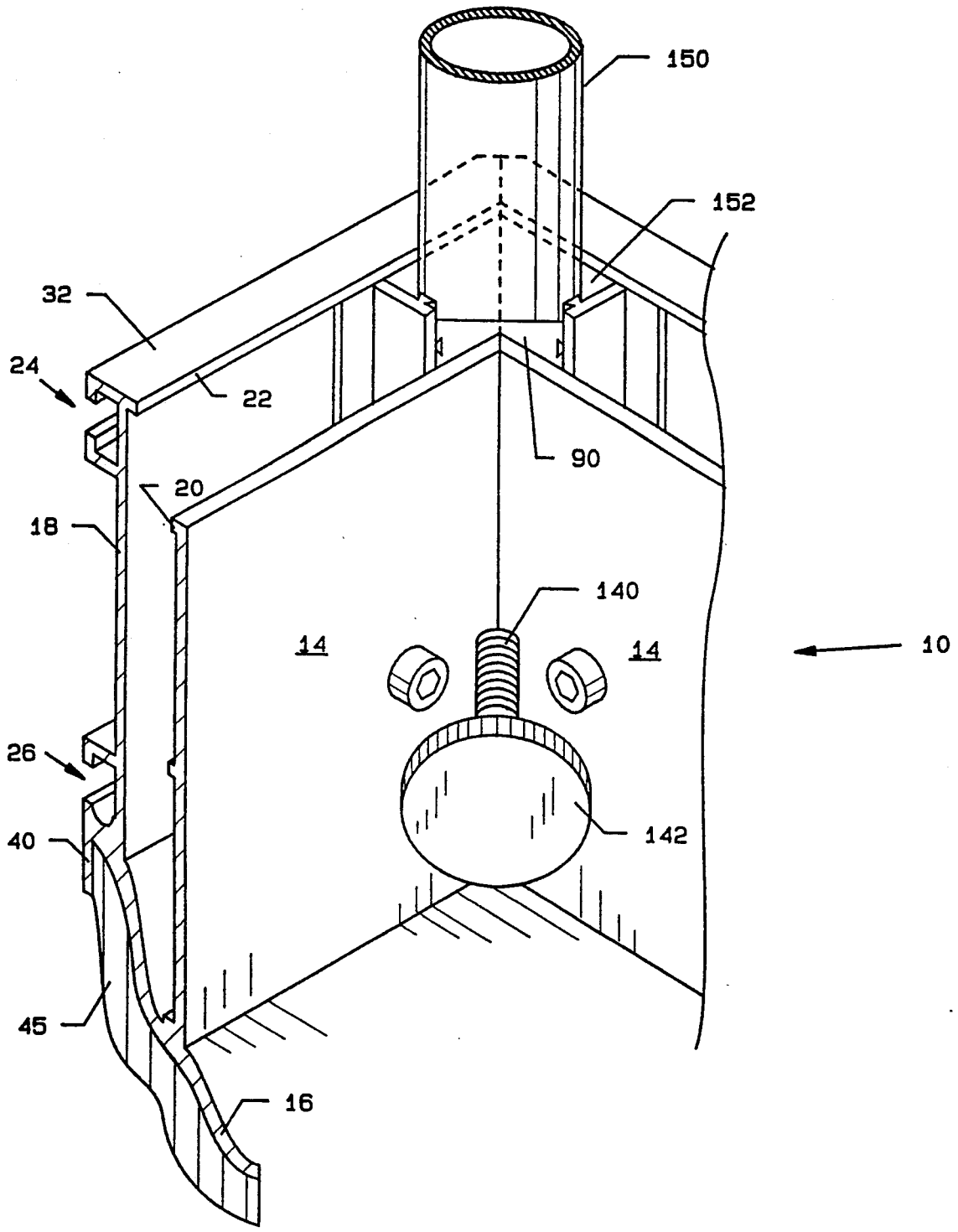
FIG. 5 illustrates an inverted bottom view of the stage platform assembly.

FIG. 1 illustrates an end view of a box channel member 12 for the stage platform assembly 10 of FIG. 5. The box channel member 12 includes an inner wall member 14, a thick connecting upper wall member 16, a thick outer wall member 18, lip members 20 and 22, and slotted channel members 24 and 26. Slotted channel member 24 is formed by right angle members having a horizontally oriented member 28 and vertically oriented member 30 pair, and by a horizontally oriented member 32 and vertically oriented member 34 pair in conjunction with the thick outer wall member 18. The slotted channel member 26 is similarly formed with the exception of the top member 36, which, at its upper region, has a support arch 38 at the lower junction of the top wall member 16, a vertical member 40 and the thick wall 18. The lower portion of the slotted channel member 26 is formed by a vertically oriented member 42 and a horizontally oriented member 44 extending from the thick outer wall member 18. A portion of the wall 18 forms part of the slotted channel member 26. A support arch 46 bridges the junction of the top wall member 16 and the thick wall 18. A support arch 48 bridges the junction of the top wall member 16 and the inner wall member 14. Lip member 22 includes an arch support 49. A lip member 47 extends along the inner surface of the inner wall member 14. A plywood top member 45 butts up to the vertical member 40, which serves as a protective member for the wood edge. Protection of the wood edge is especially significant when the platform members are stacked vertically for storage. The particular size of each component is determined by the particular application, and can be extruded from an aluminum alloy. The other members, as now described, are likewise extruded.

Figure 2:
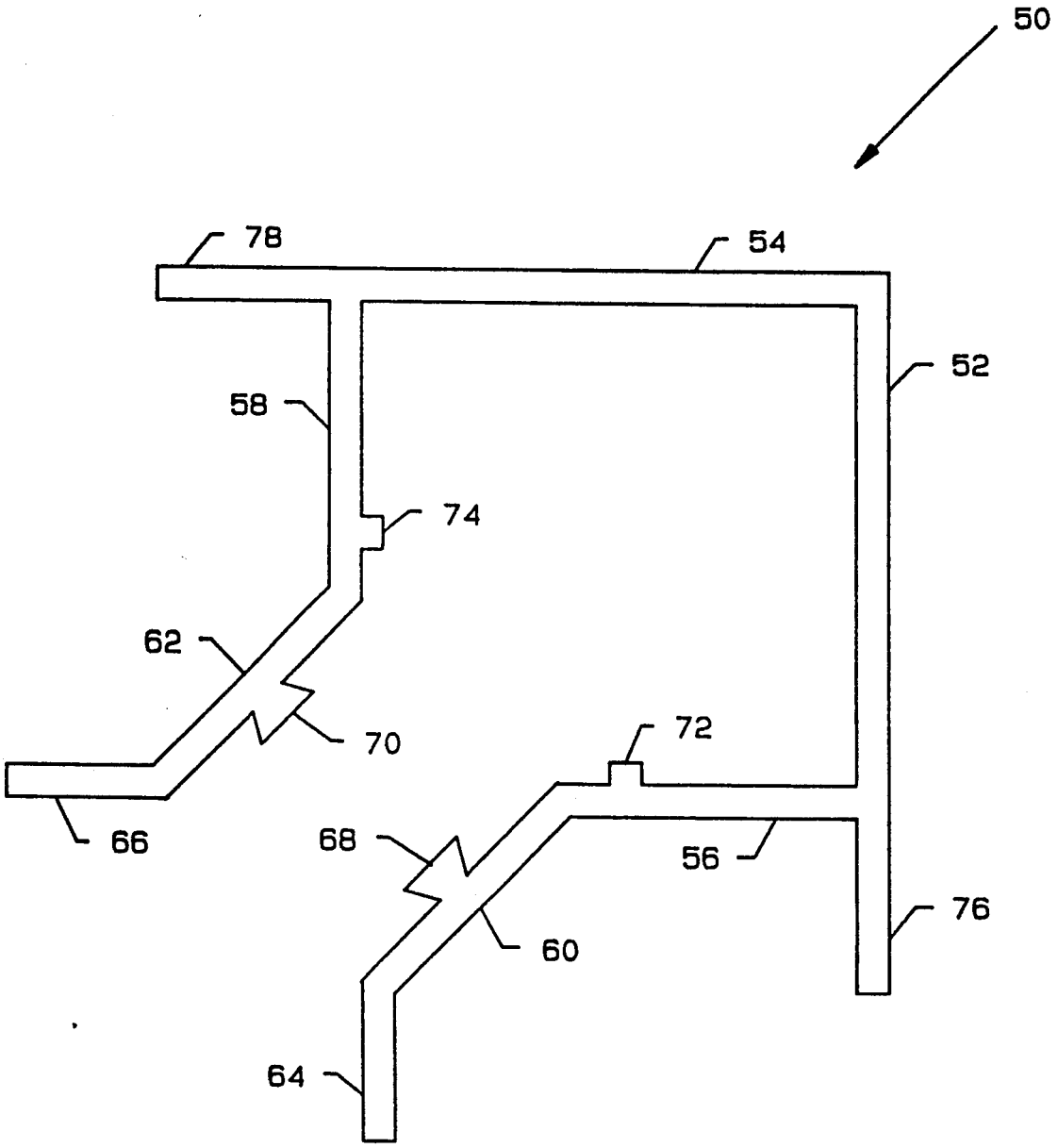
FIG. 2 illustrates a top view of a corner extrusion member.

FIG. 2 illustrates a top view of a corner extension member 50 including outer alignment walls 52 and 54, extension walls 56 and 58, angled walls 60 and 62, and inner alignment walls 64 and 66. Tongues 68 and 70 extend inwardly from the angled walls 60 and 62. Rectangles 72 and 74 are provided for reference points, and to capture support structures such as legs.

Figure 3:
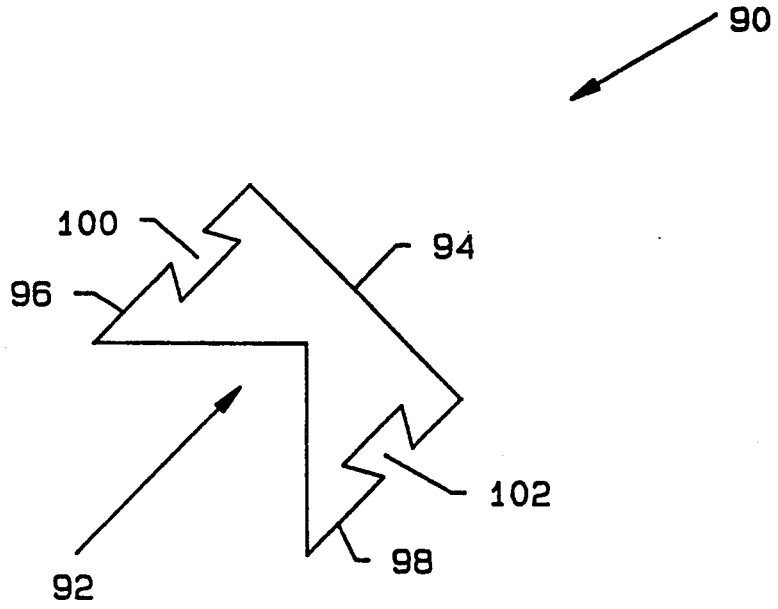
FIG. 3 illustrates a top view of a corner securing member.

FIG. 3 illustrates a top view of a corner securing member 90 including a right angle corner 92, a back 94, ends 96 and 98, and grooves 100 and 102.

MODE OF OPERATION

Figure 4:
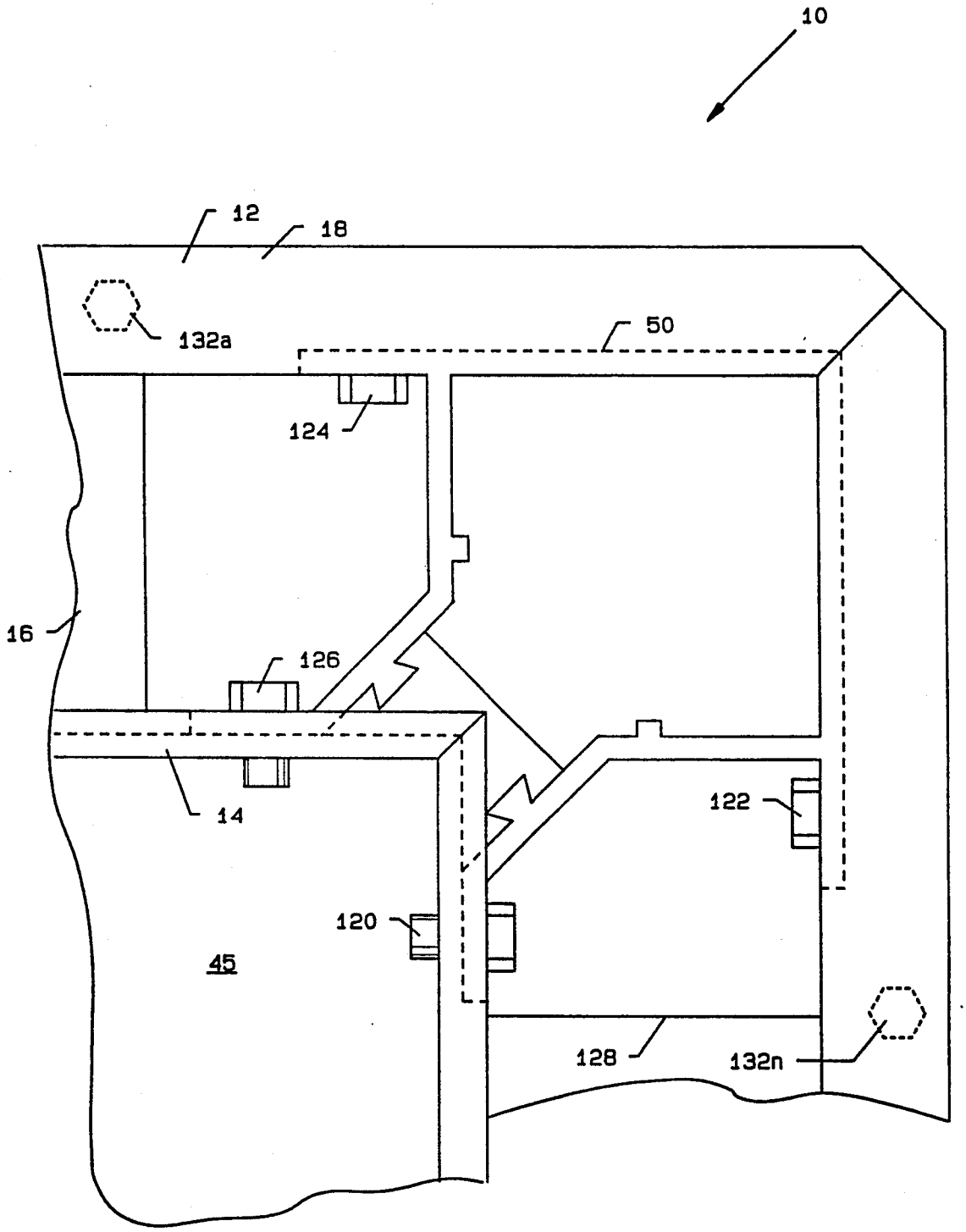
FIG. 4 illustrates a bottom view of a corner of a stage platform assembly.

FIG. 4 illustrates a bottom view of a stage platform assembly 10 including all components as previously described in an assembled configuration at one end of the stage platform by way of example and for purposes of illustration only and not to be construed as limiting of the present invention. Four nut and bolt assemblies 120, 122, 124, and 126 secure the previously described components into an end configuration about an L shaped plate 128 for alignment fit between the components. A plywood top 45, by way of example and for purposes of illustration only and not to be construed as limiting of the invention, secures to the connecting wall member 16 through holes in the connecting wall member by a plurality of leg screws 132*a*–132*n*.

FIG. 5 illustrates a perspective inverted bottom view of the stage platform assembly 10. A leg 150 secures into the area 152 for securing the stage platforms with respect to each other. Illustrated in particular is the engagement of the vertical member 40 with the edge of the plywood top 45 which affords edge protection for the platform top 45, such as during vertical stacking. Threaded shafts 140 with knobs 142 extend through the abutted wall member 14, through threads in the corner securing members 90 and against the leg members 150 to secure the leg members 150 into the corner area 152.

Various modifications can be made to the present invention without departing from the apparent scope hereof.

I claim:

1. Stage platform assembly comprising:

a. four sections of box channel members;

b. four corner extension members engaged in the ends of each of said box channel members, said corner extension members having opposing angled walls;

c. corner securing members engaged with each of said corner extension members between said opposing angled walls;

d. an L shaped plate connected between the ends of each of said box channel members; and, e. a plywood or like member secured with bolts to a connecting wall member of said box channel member.

2. Stage platform assembly of claim wherein said box channel member is extruded aluminum.

3. Stage platform assembly of claim wherein said corner extension member is extruded aluminum.

4. Stage platform assembly of claim 1 wherein said corner securing member is extruded aluminum.

5. Stage platform assembly comprising:

a. a plurality of box channel members, each including a top wall, a descending outer wall and a descending inner wall, the three walls forming a channel;

b. a plurality of corner extension members for insertion in the channel of the box channel members for connecting the box channel members to make corners to form a polygon, each corner extension member having two outer alignment walls for butting against and attaching to the descending outer walls of two adjoining box channel members, two inner alignment walls for butting against and attaching to the descending inner walls of the two adjoining box channel members, and two angled walls for connecting each outer alignment wall to its corresponding inner alignment wall;

c. a securing member for insertion in each corner extension member, having a right angle corner for contacting the inner descending walls of two of the adjoining box channel members and means for securing to the two angled walls of the corner extension member;

a platform member attached to the top walls.

6. The platform assembly of clam 5, further comprising a leg for mounting in each corner extension member.

7. The platform assembly of clam 5, further comprising an L-shaped plate for insertion in the channel of the two adjoining box channel members before insertion of the corner extension member.

8. The platform assembly of clam 5, wherein the means for securing to the two angled walls comprises dove-tailed tongues on the angled walls and corresponding grooves on the securing member.

* * * * *